US010918220B2

(12) United States Patent
Wang

(10) Patent No.: US 10,918,220 B2
(45) **Date of Patent: *Feb. 16, 2021**

(54) SLING CHAIR

(71) Applicant: AGIO INTERNATIONAL CO., LTD., Kowloon (HK)

(72) Inventor: Tsung-Ho Wang, Taipei (TW)

(73) Assignee: Agio International Co., Ltd., Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 16/879,451

(22) Filed: May 20, 2020

(65) Prior Publication Data

US 2020/0281368 A1 Sep. 10, 2020

Related U.S. Application Data

(63) Continuation of application No. 16/515,826, filed on Jul. 18, 2019, now Pat. No. 10,681,992, which is a continuation-in-part of application No. 15/260,009, filed on Sep. 8, 2016, now abandoned.

(51) Int. Cl.
*A47C 31/02* (2006.01)
*A47C 7/28* (2006.01)

(52) U.S. Cl.
CPC ..... *A47C 31/023* (2013.01); *A47C 7/28* (2013.01)

(58) Field of Classification Search
None
See application file for complete search history.

(56) References Cited

U.S. PATENT DOCUMENTS

| | | | | |
|---|---|---|---|---|
| 3,601,446 | A * | 8/1971 | Persson | A47C 31/023 297/405 |
| 4,234,226 | A | 11/1980 | Colby | |
| 5,094,507 | A | 3/1992 | Gibbs | |
| 5,224,760 | A | 7/1993 | Gibbs | |
| 5,716,101 | A | 2/1998 | Frinier et al. | |
| 5,911,478 | A | 6/1999 | Goodman | |
| 6,293,624 | B1 | 9/2001 | Gaylord et al. | |
| 6,370,714 | B1 * | 4/2002 | Elzenbeck | A47C 7/282 5/110 |
| 6,585,323 | B2 | 7/2003 | Gaylord et al. | |
| 7,192,091 | B1 | 3/2007 | Ping Sheng | |
| 7,458,641 | B2 | 12/2008 | Wang | |
| 7,731,291 | B2 | 6/2010 | Wang | |
| 8,403,421 | B2 | 3/2013 | Wang | |
| 2004/0250496 | A1 * | 12/2004 | Cvek | A47C 31/023 52/660 |
| 2007/0278840 | A1 * | 12/2007 | Wang | A47C 7/282 297/440.11 |

* cited by examiner

*Primary Examiner* — David E Allred
(74) *Attorney, Agent, or Firm* — Williams Mullen; F. Michael Sajovec

(57) ABSTRACT

A sling chair may include a frame having one or more side rails, each side rail having a J-channel, and a fabric having one or more edges. The J-channel may include a neck and a foot, and be configured to receive a rod connected to a fabric edge. A locking strip may be inserted and force fit into the J-channel to lock the fabric edge and rod in the J-channel. The locking strip may include one or more lateral protrusions for mating with a ridge along an inner surface of the side rail.

19 Claims, 9 Drawing Sheets

SLING CHAIR

CROSS REFERENCE TO RELATED APPLICATIONS

The present application claims the benefit of priority to U.S. patent application Ser. No. 15/260,009 filed Sep. 8, 2016, and is a continuation of U.S. patent application Ser. No. 16/515,826, filed Jul. 18, 2019, the disclosures of which are hereby incorporated in their entirety by reference.

STATEMENT REGARDING GOVERNMENT SUPPORT

None.

FIELD

The present disclosure relates to sling chairs, and more particularly to a sling chair wherein the side rails are adapted to receive and secure a fabric seat panel, even if attached to a cross member spanning both side rails. This eliminates the need for separate chair and web frames, and greatly enhances the packing efficiency and assembly of the sling chair.

BACKGROUND

Informal outdoor furniture, particularly of the type intended for use on decks and patios, has become quite popular. Manufactures of such furniture are called upon to offer practical, comfortable products to the consumer. For aesthetic, functional and cost reasons, it is sometimes desirable to design furniture, including chairs, which employ a supporting web suspended on a frame which is in turn suspended on a frame of the chair. The sling frame is removable from the chair, which is known as a sling chair. This construction arose since it is easier and less expensive to construct the sling and chair frame separately. Examples of sling chairs are seen in U.S. Pat. No. 5,716,101, issued to Richard D. Frinier et al. on Feb. 10, 1998, and U.S. Pat. No. 5,911,478, issued to Lloyd Goodman on Jun. 15, 1999. These prior art sling chairs lack a side rail adapted to receive and retain a cross member spanning both side rails, while also retaining a fabric seating member, as seen in the present invention. Other chair designs include those shown in U.S. Pat. No. 4,234,226, issued to Donald B. Colby on Nov. 18, 1980, and U.S. Pat. Nos. 5,094,507 and 5,224,760, both issued to Terence Gibbs respectively on Mar. 10, 1992. These prior art sling chairs lack side rails adapted to receive and retain a cross member spanning both side rails, while also retaining a fabric seating member, as seen in the present invention.

Prior art conventional sling chair construction arose since it is easier and less expensive to construct the sling and chair frame separately. However, it is apparent that conventional construction of sling chairs entails costly duplication. There remains a need to simplify construction of sling chairs, in particular, to eliminate duplicative members.

Applicant's prior solutions to these challenges, shown in U.S. Pat. Nos. 6,293,624 and 6,585,323, both of which are incorporated by reference in their entirety, described sling chairs having side rails which connect to a cross member spanning the side rails. In those solutions, each side rail included an extension bearing a socket to receive one end of the cross member. The chair has a fabric seating member retained to the side rails. The cross member and side rails provide both a structural frame for the sling chair as well as a frame for the fabric seating member. These solutions reduce the traditional redundant separate chair and sling frames to one frame.

Those solutions, while valuable improvements over the available alternatives, are not without their drawbacks. For example, due to the shape of the channel in the side rails, assembling the chair first requires sliding the fabric seating member into the side rail. As a consequence, the cross member and side rails must be assembled after inserting the fabric seating member into the side rail.

BRIEF SUMMARY

The present disclosure relates to sling chairs, and more particularly to a sling chair wherein the side rails are adapted to receive and secure a fabric seat panel, even if attached to a cross member spanning both side rails. This eliminates the need for separate chair and web frames, and greatly enhances the packing efficiency and assembly of the sling chair.

In some embodiments, a sling chair may have a frame having a side rails with an interior side, such that two side rails are generally parallel. Some embodiments may include an additional pair of parallel side rails. A side rail may have a J-channel along a length of the rail, though the length of the J-channel may be less than the length of the side rail. A fabric panel having edges, one or more edges connected to a rod, may form the seat and/or back portions of the sling chair. The rod and fabric edge may be inserted into the J-channel, and a locking strip may be inserted into the J-channel and configured to lock the rod and fabric edge into the J-channel. It should be appreciated that more than one edge of the fabric may be connected to a rod and inserted into a J-channel in this manner.

A J-channel may include a neck and a laterally offset foot. The cross-sectional width of the J-channel neck may be less than the cross-section width of the J-channel foot, thereby providing space for receiving the fabric edge and rod when the locking strip is force fit into the J-channel. In some embodiments, the laterally offset foot may be laterally offset inward toward the interior side of the rail. The rod and fabric edge may be received in the foot, and locked in position with the locking strip. In some embodiments, the fabric edge includes a loop, and the rod may be inserted into the loop. In some embodiments, the rod may be stapled or adhered to the fabric edge.

DESCRIPTION

The following description is of the best currently contemplated mode of carrying out exemplary embodiments of the present approach. The description is not to be taken in a limiting sense, and is made merely for the purpose of illustrating the general principles of the present approach.

Figure 1:
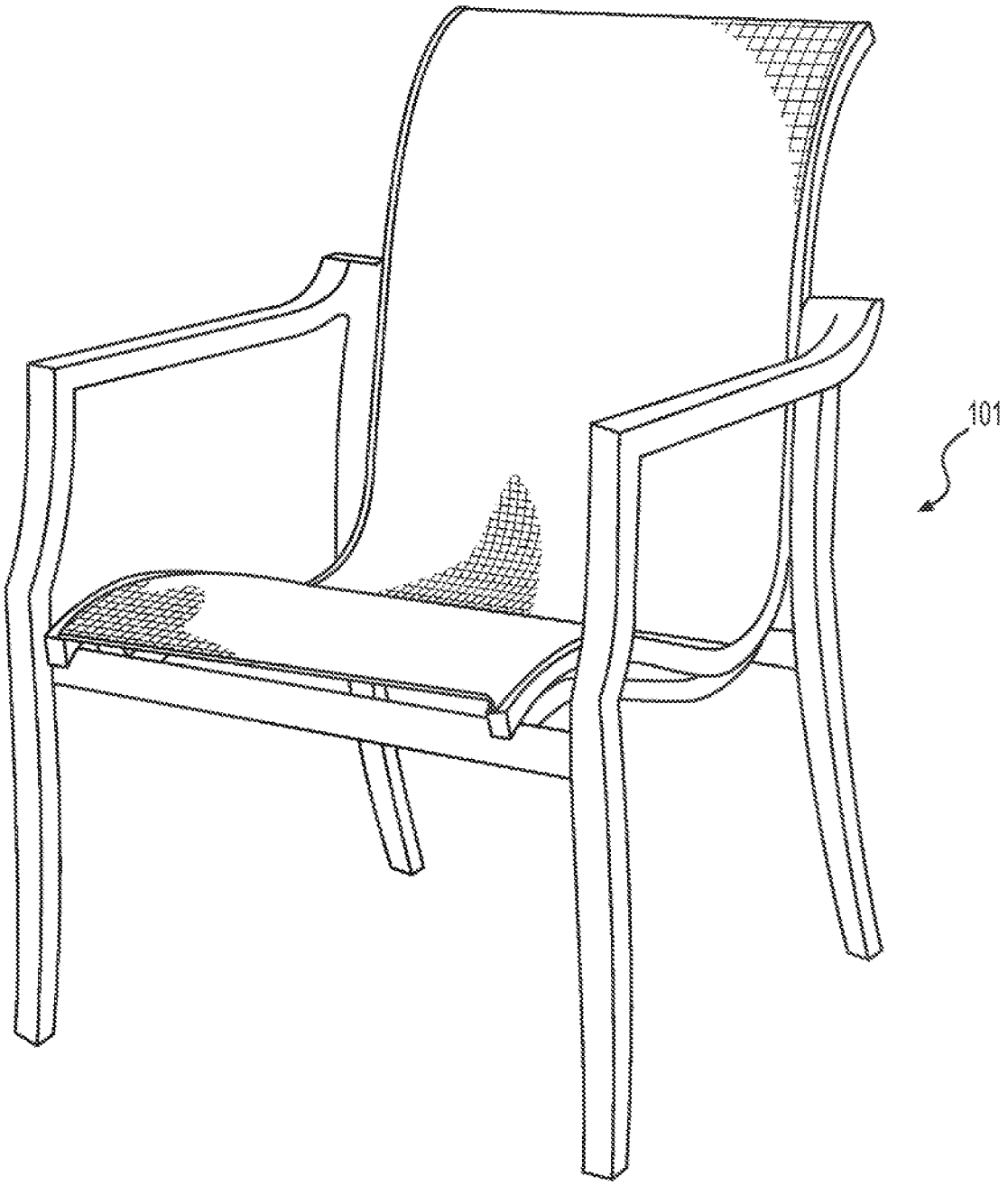
FIG. 1 Prior Art
FIG. 1 illustrates a contemporary sling chair.

FIG. 1 illustrates a contemporary sling chair 101 having one or more frame members 103, a fabric panel 105, and a chair frame 107 with rigid cross members 109. Some embodiments of the sling chair 101 may include a rigid cross member connecting the upper portions of the frame member 103 along the chair back (not visible in the view shown in FIG. 1). The chair frame 107 connects to the frame member 103 at various locations, and provides rigidity across the length of the frame member 103.

Figure 2:
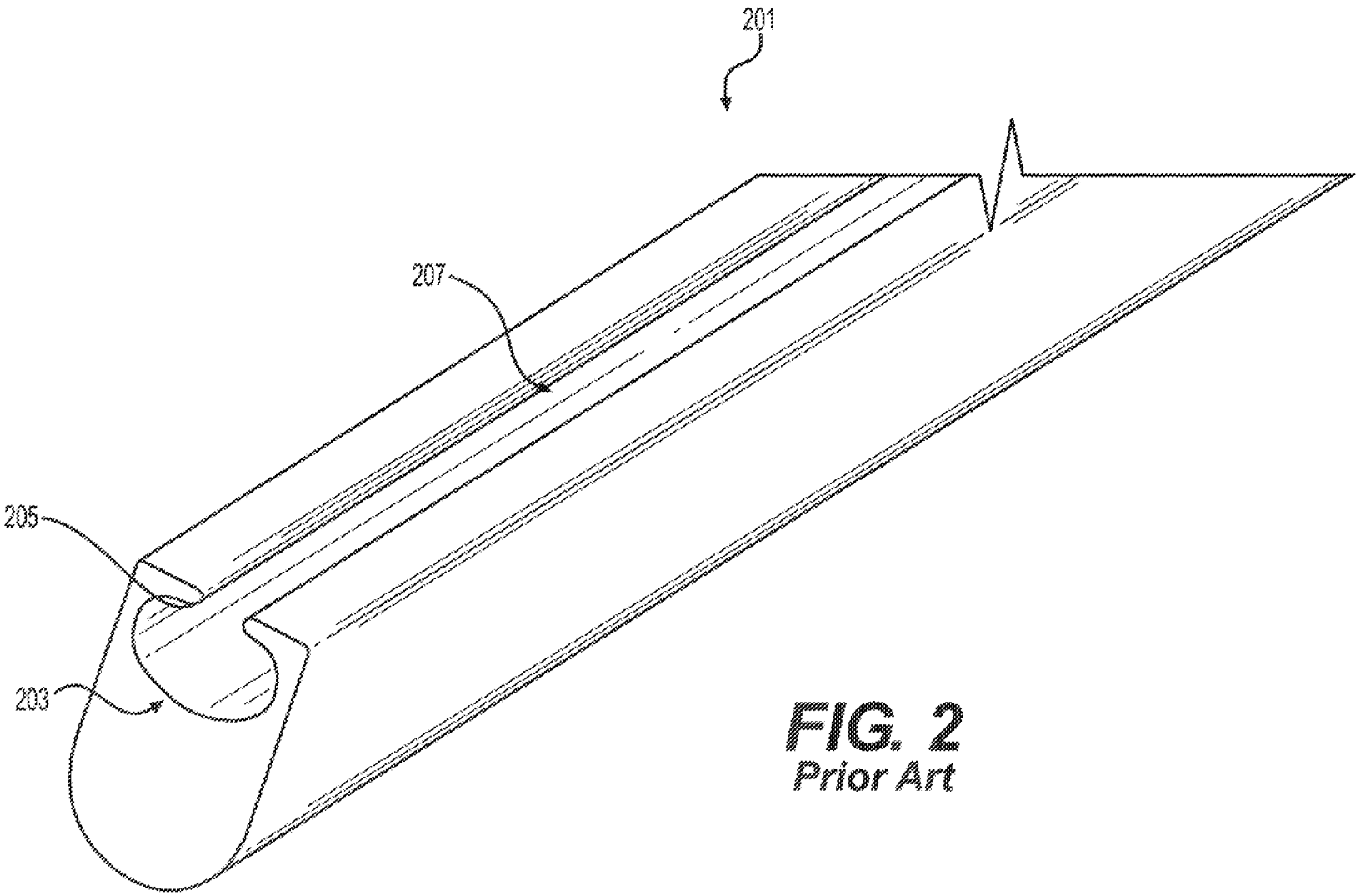
FIG. 2 Prior Art
FIG. 2 shows a C-channel present in a contemporary sling chair.

FIG. 2 shows a segment of a side rail 201 as may be present in a frame member of a contemporary sling chair. Side rail 201 includes an open C-channel 203 formed along the long axis of the side rail. It should be appreciated that side rail 201 normally defines a side portion of a sling chair, but may form the front or back portion of a chair, in some embodiments. The longitudinal C-channel 203 includes a narrow opening 207 formed by ridge 205. The opening 207 defines a space through which a fabric panel (not shown) may protrude from the C-channel 203. A rod (not shown) positioned in a looped end of a fabric panel fits into the C-channel, such that the diameter or width of the rod prevents the rod from moving through the opening 207.

Figure 3:
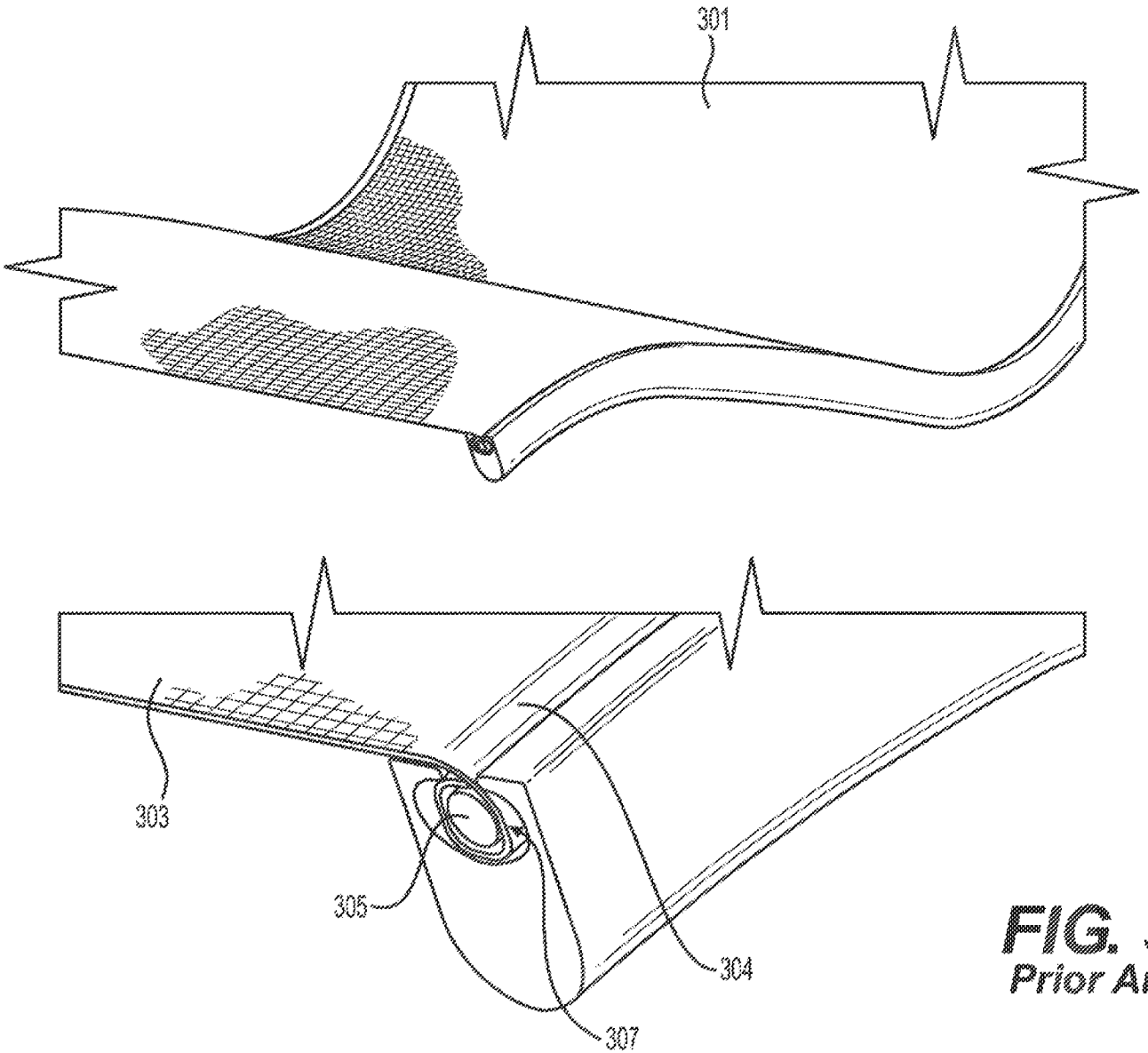
FIG. 3 Prior Art
FIG. 3 shows a fabric panel received in C-channel present in a contemporary sling chair.

FIG. 3 shows a portion of a contemporary sling chair 301, with fabric panel 303 inserted into side rail 306. As seen in the magnified portion of the drawing, rod 305 is inserted into loop 307 of the fabric panel 303. The rod 305 and panel 303 are then inserted into C-channel 309 at the open end, and slid the full length of the C-channel 309 in rail member 306. Fabric edge portion 304 protrudes from the opening of C-channel 306. Due to the diameter of rod 305, however, the rod 305 and panel 303 remain trapped in C-channel 306.

Figure 4:
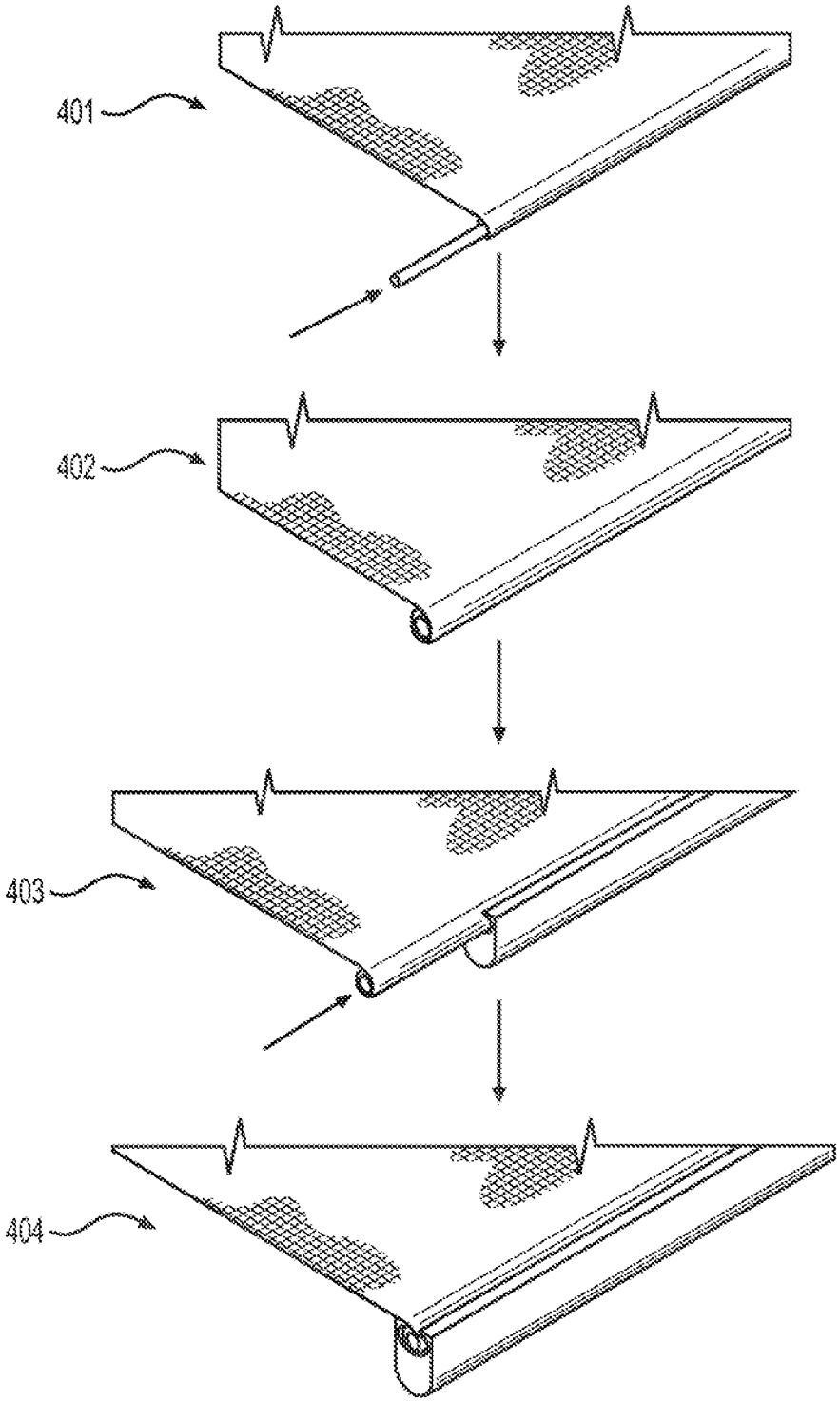
FIG. 4 Prior Art
FIG. 4 illustrates a contemporary method for assembling a sling chair.

FIG. 4 illustrates a contemporary method for assembling a sling chair. In step S401, a rod or other member is inserted into an open end of a loop on the fabric panel. In step S402, the rod is inserted the full length of the loop, and if necessary cut such that the rod does not protrude from the loop in excess of an acceptable threshold. For example, the design of the chair may allow for the rod to extend beyond the end of the fabric loop by a certain amount without impacting the assembly or appearance of the chair. In step S403, the fabric loop and rod assembly are inserted into an open end of a C-channel on a side rail. In step S404, the fabric loop and rod assembly are inserted the full length of the side rail. The process is repeated on an opposing side rail, such that the fabric panel is firmly located between side rails. Rigid cross members, or other frame components, may be connected to the side rails to complete the assembly. As shown in FIG. 1, the fabric panel 105 may be inserted the full length of the side rail 103, and thereby form the seat portion and the chair back portion of the chair 101. In other embodiments, separate panels may be used.

The contemporary approach requires a free end of a side rail to slide the fabric loop and rod into the C-channel. As a consequence, the range of suitable rail and frame designs is limited. Additionally, the contemporary approach generally requires inserting the fabric panel into two opposing sides, such that the front and back portions may be left free. Some embodiments may include additional elements to receive and/or cover such free ends of the fabric panel. The contemporary approach also requires significant time to assemble, especially if the C-channel provides relatively little free space for the fabric loop and rod to easily slide into the side rail, and also if the side rail has numerous bends and/or sharp turns.

The present approach allows for the convenient assembly of a sling chair with a fabric panel having a plurality of fabric edges inserted into channels in the frame. Generally, one or more edges of a fabric panel may include a rod, such as a rod inserted into a loop in the fabric panel, or a rod connected to an edge of the panel, to form a fabric edge and rod assembly. One or more frame members may include a J-channel having a neck region wider than the diameter or width of the edge and rod assembly. The fabric edge and rod assembly may be inserted into a J-channel in a frame member, and re-positioned to occupy a foot region of the J-channel. A locking strip may be force-fit into the neck of the J-channel, thereby locking the fabric edge and rod assembly in the J-channel. This approach may be implemented for more than one edge of the fabric panel, and may be performed sequentially or simultaneously on multiple fabric panel edges.

It should be appreciated that the shapes of the J-channel, rod, and locking strip may vary between embodiments, without departing from the principles described herein. The following description covers demonstrative embodiments of various aspects of the present approach.

Figure 5:
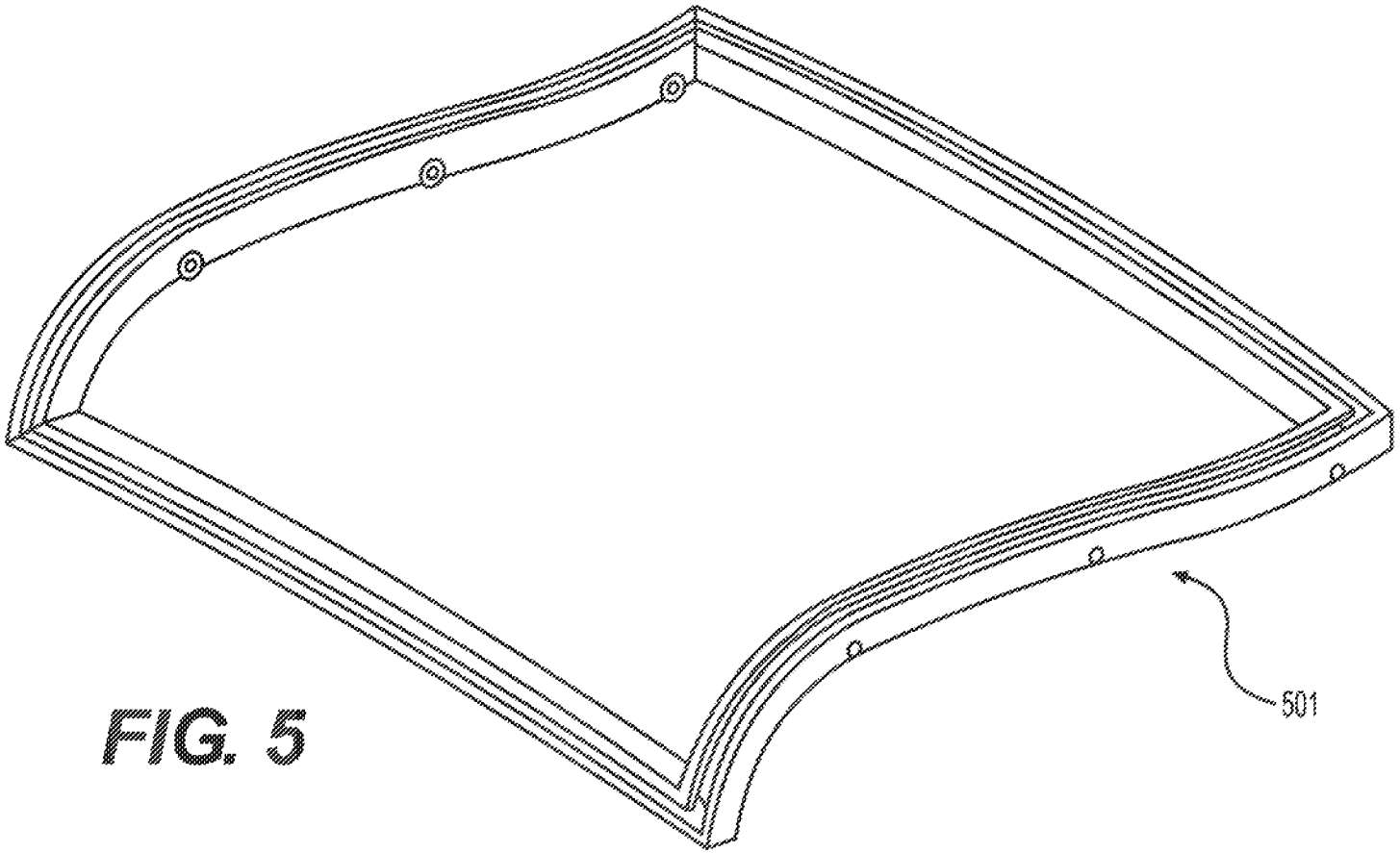
FIG. 5 shows an assembled frame according to one embodiment of the present approach.

FIG. 5 shows an assembled frame 501 according to one embodiment of the present approach. Frame 501 is assembled, and includes no free end to insert a fabric loop and rod using the contemporary approach. For example, side rails forming frame 501 may be individual frame members welded together or otherwise joined, or formed as a single-piece frame, such as through injection molding. Fabric panels normally would not fare well against welding heat or formation of a single-piece frame. Thus, the contemporary approach is unsuitable for frame designs such as shown in FIG. 5. The present approach, however, is suitable for frame designs such as shown in FIG. 5, and also allows for rapid assembly in a wide variety of rail and frame configurations.

In some embodiments, the frame 501 may be further comprise a base and cross members. The cross members may be coupled to the side rails, and may extend at generally a 90 degree angle from the side rails. The frame 501 may further be coupled to at least one ground engaging member (not shown). The frame 501 may be used in connection with standard chairs, lounges, rockers, chaises, or any type of chair comprising a resting surface now known or later discovered. In some embodiments, multiple frames 501 may be used or a seat area and a back rest area. In other embodiments, a single, unitary frame may be used. The frame 501 may be coupled to the support rails that extend downward and inward from the frame 501. In some embodiments, the support rails may extend at an angle between 20 and 75 degrees. The support rails may then be further coupled to at least one ground engaging member. Alternately, the at least one ground engaging member could form the legs of the chair.

Figure 6:
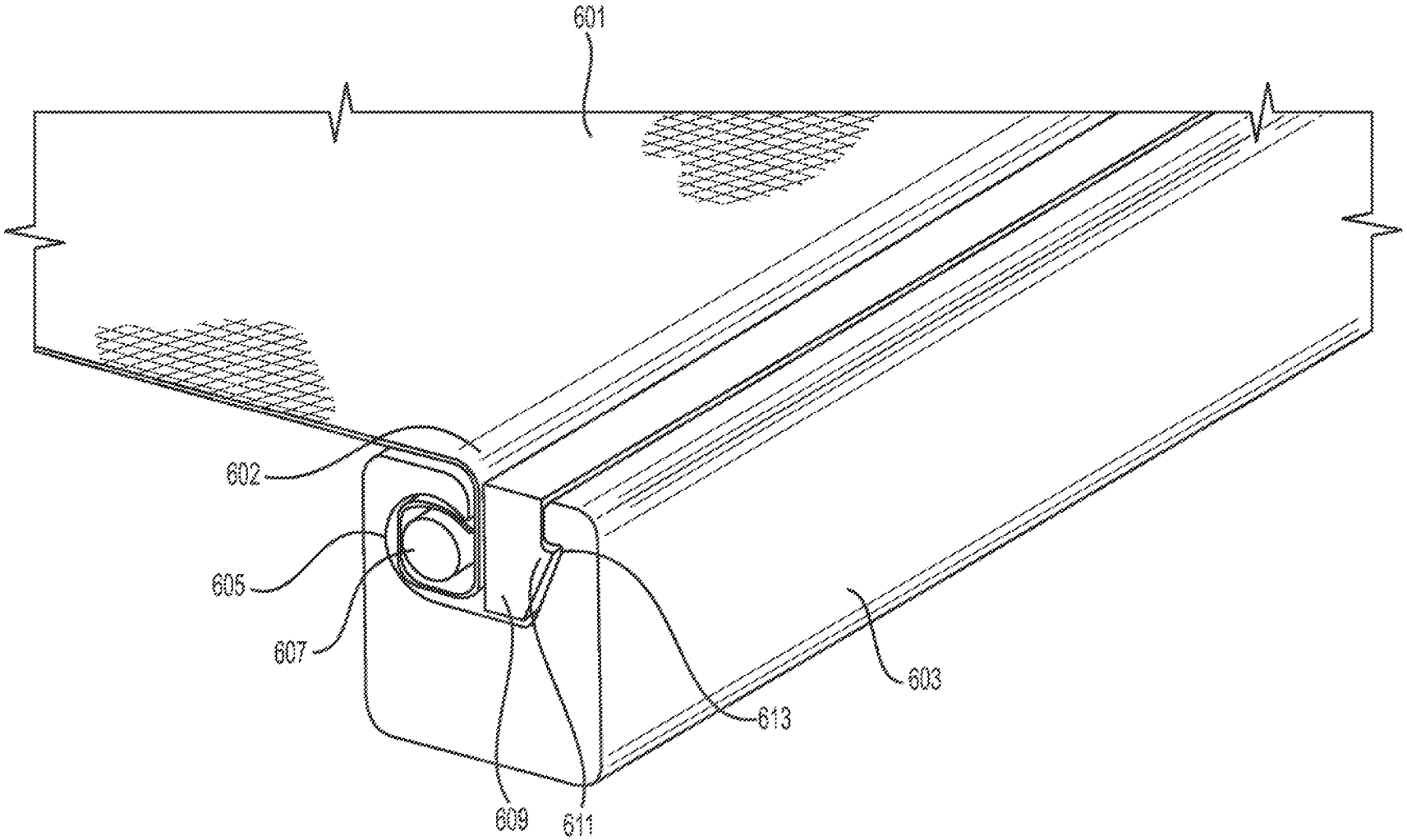
FIG. 6 illustrates a cutaway view of a side rail according to one embodiment of the present approach.

FIG. 6 illustrates a cutaway view of a side rail according to one embodiment of the present approach. As seen in FIG. 6, the present approach replaces the C-channel used on contemporary sling chairs with a J-channel. In side rail or frame member 603, J-channel 607 extends along a length of the frame member 603. The side rail 603 may be substantially rectangular. The side rail 603 may have a top, a base, and two lateral sides. The top and base may be substantially parallel to one another, and the two lateral sides may be substantially parallel to one another. The J-channel 607 may extend the full length of frame member 603, or in some embodiments less than the full length of frame member 603. Fabric panel 601 includes a loop 605 for receiving rod 606. The material used for rod 606 may vary in different embodiments. For example, rod 606 may be a rigid material, such as extruded aluminum or plastic, or a semi-rigid material such as rubber. Unlike contemporary approaches, the diameter of rod 606 does not need to be greater than the width of neck 604—if it was, then the assembly process would require inserting the fabric and rod assembly into the J-channel 607 through an end, as opposed to through the neck 604. However, the diameter or width of the rod 606 should be size such that, when the locking strip 609 is inserted, the fabric and rod assembly will remain secured in the J-channel.

Loop 605 may be a complete loop, i.e., an end of the fabric panel 601 may connect to another portion of the fabric panel. In other embodiments, the loop 605 may be an incomplete loop, i.e., an end of the fabric panel 601 may connect to the rod 606. In some embodiments, for example, rod 606 may be stapled and/or nailed to an edge of fabric panel 601. Loop 605 and rod 606—the fabric and rod assembly—may be inserted into the J-channel 607 through neck 604, and occupy a lower portion of the J-channel referenced as the foot 613. As shown in FIG. 6, foot 613 of J-channel 607 may be a channel extension laterally offset from neck 604. The laterally offset foot 613 provides a receiving portion for receiving all or a portion of the loop 605 and rod 606 assembly. The loop 605 and rod 606 assembly may fit entirely within the substantially circular foot area 613 below a ledge. In some embodiments, when in place, the rod 606 may fit entirely below the ledge. The foot area 613 may be structured to wholly contain the rod 606 such the rod 606 may not extend laterally beyond a distal end of the ledge. Alternately, the foot area 613 may be structured such that the rod 606 may not extend into an area directly below the neck 604, but is instead entirely lateral to the area directly below the neck 604. In other embodiments the rod 606 may extend partially into the neck 604. In other embodiments, the rod 606 and loop 605 may not extend into an area directly below the neck 604. The foot 613 may be laterally offset inward, such that the loop 605 and rod 606 assembly wraps around an inner wall of the J-channel 607, such as is shown in FIG. 6. In other embodiments, the foot 613 may be laterally offset outward. In some embodiments, the foot of the J-channel may contain mating structures to secure the fabric and rod assembly in the J-channel. For example, the foot may include protrusions configured to mate with indentations in the rod (or vice versa). Additionally, some embodiments may include an adhesive layer to secure the fabric and rod assembly in the foot.

The laterally offset foot 613 is partially defined by the ledge in an upper area. The ledge may have a top that is substantially flat and forms part of the top of the side rail 603. The top of the ledge may be substantially parallel to the base of the side rail. A lip of the ledge may extend downwardly and define a portion of the neck. The ledge may have an outer surface that is proximate the top of the ledge as well as an outer surface of the lip. The ledge also may have an inner surface that may be curved to partially define a generally circular foot area. The top of the ledge may transition downwardly to form the lip at approximately a 90 degree angle. However, the ledge and lip may have a partially curved outer surface such that the ledge and lip form a rounded corner as the top of the ledge transitions downwardly. In some embodiments, the lip may extend vertically below an uppermost point of an inner surface of the ledge. The uppermost point may be the apex of the foot area.

The curved outer surface of the ledge may increase the surface area against which the fabric panel may contact. The curvature of this point of the neck may reduce the shear force against the portion of the fabric panel in contact with the frame. This may reduce the potential for tearing or other damage to the fabric.

The ledge may also have a width that is variable. The width of the ledge may be different at various points of the ledge from a point of the outer surface of the ledge directly downward to a corresponding point of the inner surface of the ledge. The ledge may have a smaller width from a point on the outer surface of the ledge directly above an apex of the laterally offset foot 613.

A locking strip 609 is inserted into the J-channel 607 and prevents the loop 605 and rod 606 assembly from exiting through the neck 604. The locking strip 609 may be a length of material, such as aluminum, wood, or plastic. In some embodiments, the locking strip may extend the full length of the J-channel 607 to provide a tight force-fit. In other embodiments, the length of the locking strip 609 may be less than the length of the J-channel 607. Some embodiments may include multiple locking strips 609 in a J-channel 607, arranged end-to-end and/or side-by-side, as may be appropriate for the embodiment. The cross-sectional profile of the locking strip 609 may vary in different embodiments. For example, the locking strip 609 shown in FIG. 6 has a rectangular profile with a lateral protrusion 611 along an outer surface and configured to mate with a corresponding ridge 613 on an inner surface of the J-channel 607.

The locking strip 609 may have a top and a base that are substantially parallel to one another. The locking strip 609 may have a back and an engaging side having a lateral protrusion. The back and the engaging side may be substantially parallel to one another through the neck. The back may be generally flat from the top of the locking strip to the base. The back may extend at approximately a 90 degree angle from the top. The back may also extend at approximately a 90 degree angle from the top. In some embodiments, the top and the bottom have a similar length. In other embodiments, the base has a length less than a length of the top.

The flat back of the locking strip 609 may serve to increase the area of contact with the fabric panel 601. As is shown in FIG. 6, the fabric panel 601 may be in contact with a majority of the flat back. In some embodiments, the fabric panel may be in contact with the flat back for more than 75% of a length of the flat back.

The increased area of contact with the back may aid in force distribution to reduce pressure, as a larger area of contact may reduce the pressure between the fabric panel 601 and the locking strip 609. Amontons' Second Law of Friction states that the force of friction is independent of the apparent area of contact. Friction is a force that opposes the relative lateral motion of two solid surfaces in contact. In the sling chair, the fabric panel 601 may be in contact with the J-channel 607, the locking strip 609, and the ledge. While the force of friction is independent of the apparent area of contact, having a larger area of contact between two surfaces reduces the pressure between the two surfaces. This may reduce the shear force at a single contact point and may reduce the potential for ripping and tearing of the fabric panel 601. Greater area of contact increases the area subject to friction and also may lend itself to a secure fit. The J-channel 607, ledge, and locking strip 609 may be configured to provide a secure fit for the rod and fabric panel. The J-channel 607, ledge, and locking strip 609 may also be configured such that the force of the friction is distributed among a greater contact surface area and thus configured to avoid ripping, tearing, and shearing. In some embodiments, only a single layer of fabric may extend from the foot area 613. In other embodiments, only a single layer of fabric may extend outwardly from the neck 604.

When the sling chair is in use, for example, if a user were to sit in the sling chair, force is applied downwardly on the fabric panel 601. In some embodiments, the force is applied from a central area of the fabric panel 601. The central area is defined by the area between the first edge and the second edge of the fabric panel 601. In some embodiments, the two edges are opposite one another, and may each be secured in the J-channel 607. Thus, when the force is applied downwardly from a central panel, each opposite edge is pulled toward a middle of the fabric panel 601. The application of the force in the central area of the fabric panel 601 is offset by each opposite edge in a mirror image. The application of force pulls each opposite edge downwardly and toward the middle. To keep the sling chair from collapsing, the opposite edges must be sufficiently secured to prevent the fabric panel 601 from being pulled out of the J-channels 607. They also must be able to offset the force. If the opposite edges were not sufficiently secured or configured to offset the downward force, the fabric panel 601 of the sling chair would become dislodged and the sling chair would not be capable of being used if the fabric panel 601 is not pulled taut once a downward force is applied.

The prior art has a decreased area of contact with the back. When force is exerted on the fabric panel 601, the fabric panel 601 is stretched or pulled in the J-channel 607 toward the central area. The fabric panel 601 is then pulled against the ledge and the back of the locking strip 609. In the prior art, the decreased area of contact may have resulted in increased concentration of the friction force at the contact surface area. As the contact surface area increases, the friction force is distributed across the surface area resulting in a decreased friction force at any particular point of the contact area.

As is shown in FIG. 6, an upper surface of the ledge is curved to allow for a greater potential for contact surface area. Further, the fabric panel 601 is in increased contact with the back of the locking strip 609. This increased contact may serve to spread the friction over an increased area as opposed to having a single or few points of contact where the fabric could rip, shred, or shear. The curved surface of the ledge may allow not only for increased contact area but also eliminate corners or edges that could increase the potential for the fabric panel 601 to rip or shear.

The lateral protrusion may take a variety of shapes, and preferably forms a detent lock against the corresponding ridge that precludes movement of the locking strip 609 upward through neck 604 after insertion. It should be appreciated that one or more lateral protrusions may be present on an inner surface and/or on an outer surface of the locking strip 609. In other embodiments, the cross-sectional profile of the locking strip 609 may resemble a trapezoidal shape, among other possible shapes. Some embodiments may include a tapered profile to form a wedge. It should be appreciated that numerous profiles are possible, and may be advantageously configured to mate with a corresponding profile of the J-channel. In the embodiment shown in FIG. 6, the locking strip 609 is positioned to the outside of the fabric panel 601, such that fabric does not fold over or cover the locking strip 609. In such embodiments, the foot 613 of the J-channel 607 may be positioned on an inner surface of frame member 603. In other embodiments, the J-channel 607 may be the mirror image of what FIG. 6 shows, such that the loop 605 and rod 606 assembly is on the outside portion of frame 603, and the locking strip 609 is on the inside of frame 603. In such embodiments, the fabric panel 601 may fold over the locking strip 609 as it stretches from the J-channel 607 to another frame member (not shown).

The J-channel 607 in the embodiment shown in FIG. 6 generally resembles a 1' or a boot, but the shape may vary from what is shown in the drawings. The J-channel 607 includes an upper neck of a first width, and a lower foot of a second width. It should be appreciated that "upper" and "lower," as used herein, do not necessarily denote the orientation of the chair, but instead the relative location of the neck 604 to the foot 613. The first width defines a lateral ridge along a length of the frame member 603, through which the loop 605 and rod 606 assembly and the locking strip 609 may be inserted. In some embodiments, the length of the ridge may be less than the length of the frame 603. In other embodiments, the ridge may extend along the entire length of the frame 603. The second width is greater than the first width, such that the foot 613 of the J-channel 605 is wider than the neck 604 when viewed in the direction of the ridge, i.e., cross-sectional width.

The J-channel 605 may take a number of shapes. For example, the neck 604 may have generally parallel side walls, or nonparallel side walls, forming a wedge or v-shaped profile. Additionally, one or more surfaces defining the neck may be curved. For example, FIG. 6 shows the inner surface of frame member 603 under fabric panel 601 curved, to increase the surface area against which the fabric panel 601 may contact. The curvature also reduces the sheer force against the fabric panel portion 602 in contact with the frame 603, thereby reducing the potential for tearing or other damage to the fabric. The foot 613 may also take a different shape, depending on the embodiment. FIG. 6 shows the interior cavity of the foot as having a generally circular shape along an inner wall of frame member 603, to accommodate fabric loop 605 and circular rod 607. Other embodiments may feature different geometries, such as, for instance, to accommodate a rod 607 having a rectangular or square cross-sectional shape. In some embodiments, foot 613 may be configured to receive loop 605 and rod 607 in their entirety.

Additionally, a side wall of the J-channel 605 may include one or more lateral ridges 611 along a length of the J-channel 605. Lateral ridge 611 may provide a mating surface for a corresponding one or more lateral protrusions on locking strip 609. It should be appreciated that the relative positions of the lateral protrusion and lateral ridge 611 may be reversed. The locking strip 609 may be inserted into J-channel 607, forming a force-fit at the neck 604. The force-fit prevents the loop 605 and rod 606 assembly and the locking strip 609 from exiting the J-channel. In embodiments with one or more corresponding lateral protrusions and ridges 611, the mating of the protrusion and the ridge increases the force-fit of the locking strip 609 in the J-channel 607, thereby enhancing the integrity of the overall assembly. It should be appreciated that the corresponding lateral protrusions and ridges 611 may take the form of a single structure along the length of the J-channel, or individual structures repeated at one or more intervals in the J-channel and corresponding structures along the rod 606. For example, a sequence of bumps and depressions may be used in some embodiments.

Figure 7:
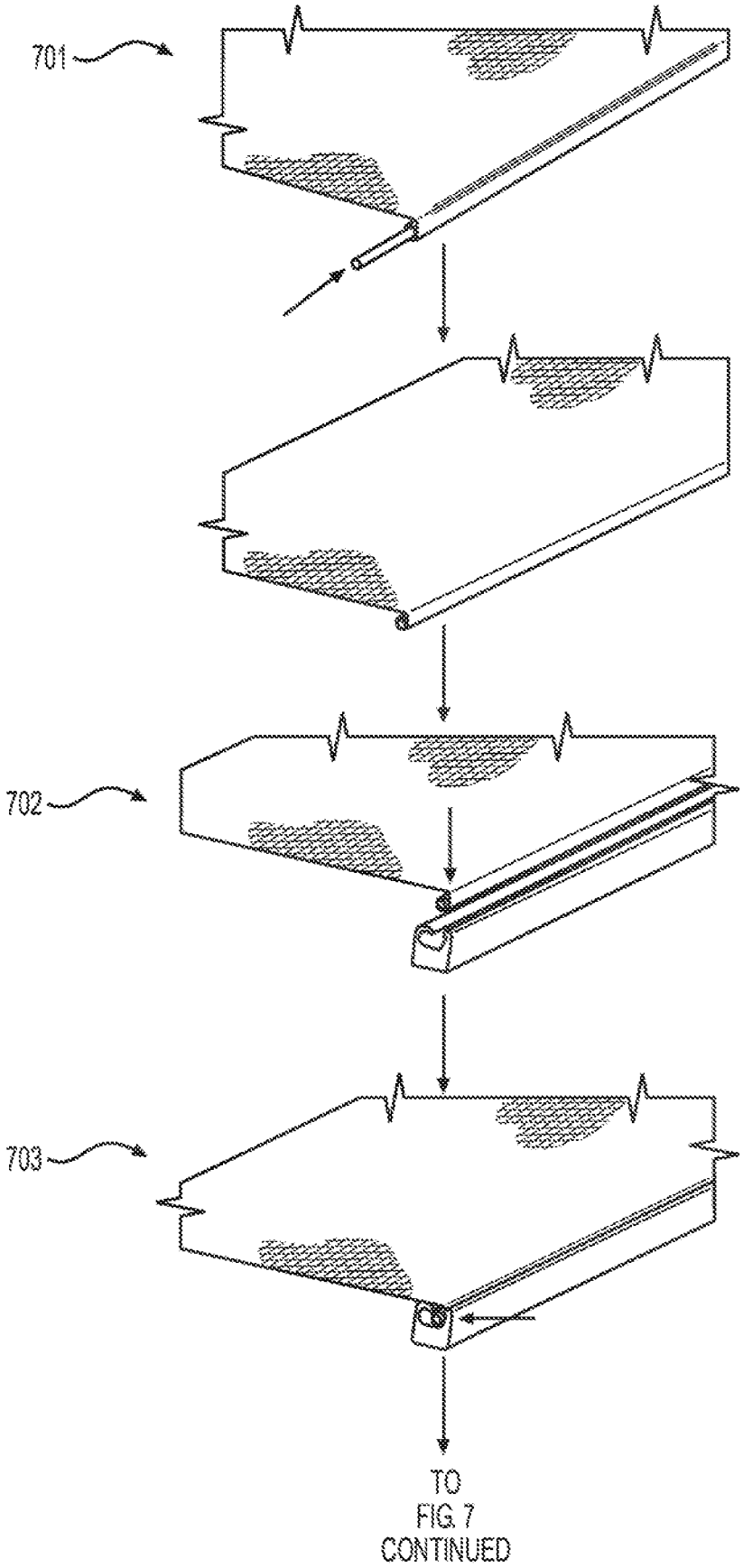
FIG. 7 illustrates a method for assembling a sling chair according to one embodiment of the present approach.
Figure 7:
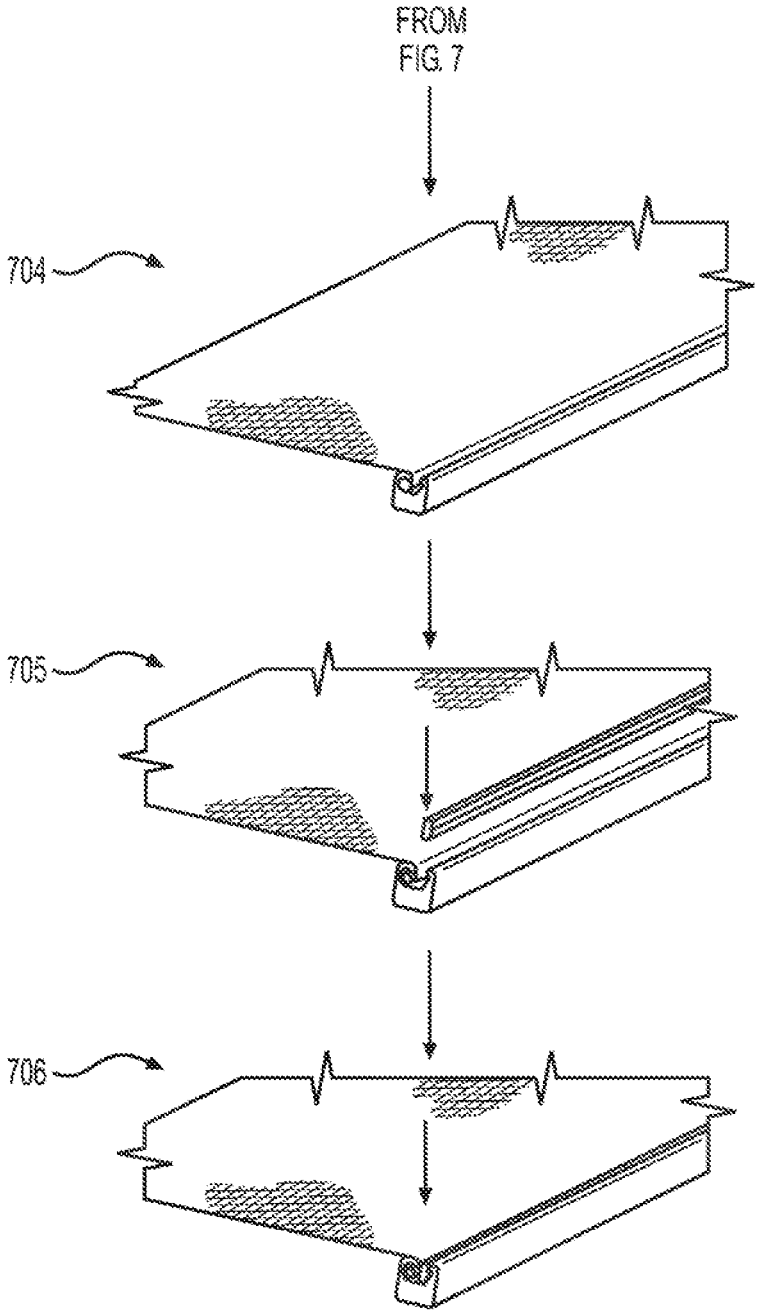

FIG. 7 illustrates a method for assembling a sling chair according to one embodiment of the present approach. In step S701, a rod is inserted into a loop in the fabric material. It should be appreciated that in other embodiments, the rod may be connected to a portion of the fabric, such as through an adhesive or mechanical elements, such as staples and/or nails. In step S702, the fabric and rod assembly is inserted into a J-channel in one or more frame elements. In step S703, the fabric and rod assembly is aligned in the frame as needed, pursuant to the embodiment. In step S704, the fabric and rod assembly is moved into the foot of the J-channel, creating a space for insertion of the locking strip. In step S705, a locking strip is positioned in the J-channel. In step S706, the locking strip is force-fit into the J-channel, locking the fabric panel, loop, and rod into position in the J-channel. In embodiments in which the fabric panel covers the locking strip, the fabric panel may be folded over the locking strip to complete the assembly. It should be appreciated that these steps may be repeated for other ends of the sling chair. In some embodiments, these steps may be performed simultaneously for more than one end of the fabric panel. One of ordinary skill in the art should recognize that certain steps may be combined without departing from the principles of the present method.

Figure 8:
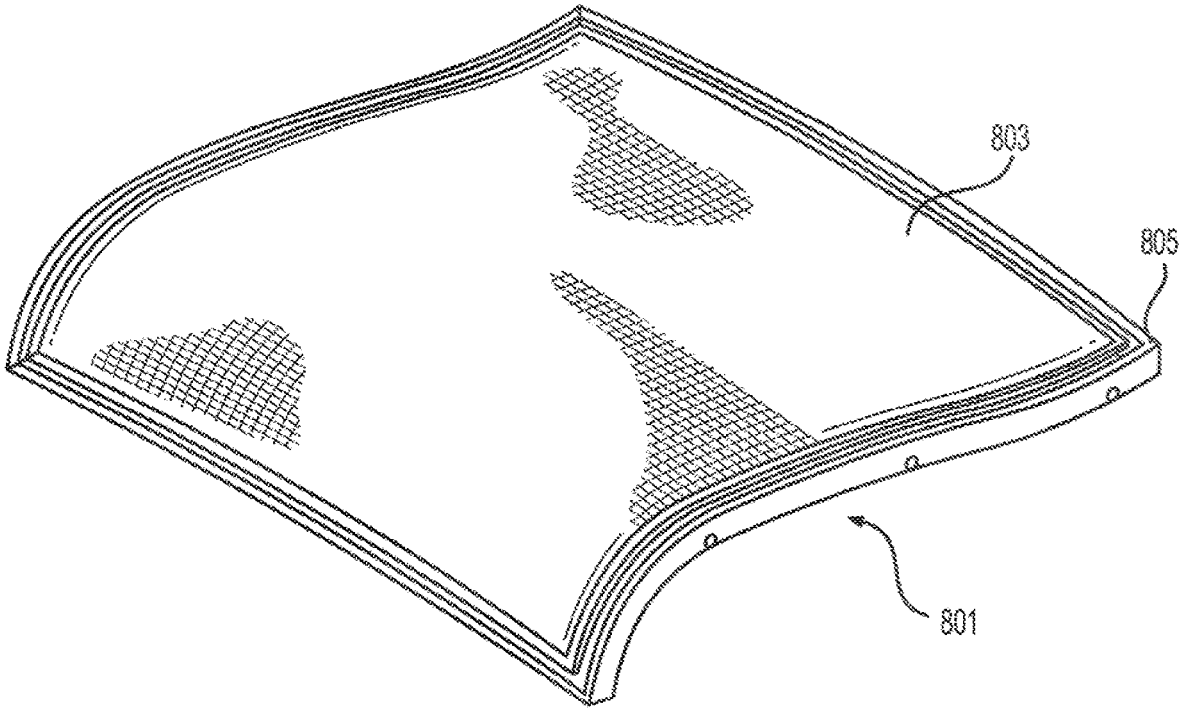
FIG. 8 illustrates an assembled frame according to one embodiment of the present approach.

FIG. 8 illustrates an assembled frame according to one embodiment of the present approach. Frame 801 includes four frame members welded together. Fabric panel 803 has ends (not shown) inserted into J-channels pursuant to the present approach. In this embodiment, all four edges of the fabric panel 803 may be inserted, or alternatively two opposing ends of the fabric panel 803 may be inserted. In embodiments with a frame member having one or more curves, the edge of the fabric panel adjacent to the curved frame member should be inserted into a J-channel of that frame member to cause the fabric panel to have the same curvature of the curved frame member. For example, in FIG. 8, frame members 805 and 807 are curved. Fabric panel edges adjacent to frame members 805 and 807 should be inserted into J-channels of those members, otherwise fabric panel 803 may droop. Additionally, fabric panel edges adjacent to straight frame members 809 and 811 may be inserted into J-channels of those members. In some embodiments, one or more of the frame members 805, 807, 809, and 811 may be curved. The fabric panel 803 may be stretched upon insertion to accommodate the curvature and form a 3D curved surface (as opposed to a flat plane). The additional surface area provided by such embodiments receives more of a user's weight, thereby enhancing the comfort as opposed to contemporary products.

The embodiment shown in FIG. 8 may be assembled according to a method such as shown in FIG. 7. Fabric panel edges may be sequentially inserted into J-channels and then fixed in place with a locking strip, or alternatively edges may be simultaneously inserted into J-channels and fixed in place with locking strips. It should be appreciated that the shape of the frame 801 may be varied according to design preferences. For example, the frame may include one or more curves as shown in FIG. 8. As another example, the frame may include a chair back portion and a seat portion, such that a single fabric panel provides the seat and back portions of a sling chair. Alternatively, separate fabric panels may be used to form the seat and/or back portions of a sling chair. One of ordinary skill in the art should appreciate that numerous possibilities are available, and that the scope of the present approach is not limited by the embodiments described herein.

The terminology used herein is for the purpose of describing particular embodiments only and is not intended to be limiting of the approach. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present approach may be embodied in other specific forms without departing from the spirit or essential characteristics thereof. The disclosed embodiments are therefore to be considered in all respects as illustrative and not restrictive, the scope of the present approach being indicated by the claims of the application rather than by the foregoing description, and all changes which come within the meaning and range of equivalency of the claims are therefore intended to be embraced therein.

What is claimed is:

1. A sling chair comprising:

a frame having a first side rail having an interior side and a second side rail having an interior side, the first and second side rails each generally parallel to one another, and each side rail having a J-channel along a length of the rail, wherein the first side rail J-channel has a neck and a laterally offset foot disposed at a lower portion of the neck, the foot being laterally offset inward toward the first interior side;

a fabric panel having first and second edges, the first and second edges generally parallel to one another;

a first rod coupled to the first edge and inserted into the neck of the first side rail J-channel; and a first locking strip inserted into the first side rail J-channel and configured to lock the first rod and the first edge into the first side rail J-channel;

wherein the foot has a foot area having a shape conforming to a shape of the rod so that the foot area is configured to receive the first rod from the neck of the J-channel;

wherein the shape of the foot area is partially defined by a ledge of a top of the side rail, the ledge having a top that is substantially flat and generally parallel to a base of the first side rail, the ledge having a variable thickness and further having a lip, the lip extending vertically below an uppermost point of an underside surface of the ledge;

wherein when the sling chair is in use, the fabric panel is in contact with an inner surface of the foot area, the ledge, and the locking strip.

2. The sling chair of claim 1, further comprising a second rod connected to the second edge and inserted into the second side rail J-channel, and a second locking strip inserted into the second side rail J-channel and configured to lock the second rod and the second edge into the second side rail J-channel.

3. The sling chair of claim 1, wherein the first rod and the first edge are received in the laterally offset foot.

4. The sling chair of claim 2, wherein the second side rail J-channel comprises a neck and a laterally offset foot, the laterally offset foot being laterally offset inward toward the second rail interior side, further wherein the second rod and the second edge are received in the laterally offset foot.

5. The sling chair of claim 1, wherein the first edge comprises a loop, and the first rod is inserted in the loop.

6. The sling chair of claim 2, wherein the second edge comprises a loop, and the second rod is inserted in the loop.

7. The sling chair of claim 1, wherein the first rod is stapled to the first edge.

8. The sling chair of claim 4, wherein the second side rail J-channel has a second neck and a second laterally offset foot disposed at a lower portion of the second neck, the second foot being laterally offset inward toward a second interior side, wherein the second foot has a second foot area having a shape conforming to a shape of the second rod and partially defined by a ledge of a top of the second side rail, the second foot area having an inner surface, wherein the J-channels of the first and second side rails offset a downward force applied to a central area of the fabric panel by securing a first end and a second end of the fabric, wherein the first and the second ends are secured such that a friction force is distributed among the first and second locking strips, the inner surface of the foot area of each of the first and second J-channels, and the ledge of each of the first and second J-channels.

9. The sling chair of claim 1, wherein the first locking strip comprises a lateral protrusion configured for mating with a corresponding ridge formed in the first side rail.

10. The sling chair of claim 1, wherein the fabric panel is a single layer of fabric.

11. The sling chair of claim 1, wherein the neck has side walls that are generally parallel to one another and at least one surface defining the neck is curved.

12. The sling chair of claim 1, wherein the neck has side walls that are generally parallel to one another, wherein the side walls are approximately the same length.

13. The sling chair of claim 9, wherein the corresponding ridge is at approximately the same height as a distal end of the lip below the top of the first side rail and above a base of the J-channel.

14. The sling chair of claim 10, wherein only a single layer of fabric extends from the foot area.

15. A sling chair comprising:

a frame having a first side rail having an interior side and an exterior side, and a second side rail having an interior side and an exterior side, the first and second side rails each generally parallel to one another, and each side rail having a J-channel along a length of the rail, wherein the first side rail J-channel has a neck and a laterally offset foot disposed at a lower portion of the neck, the foot being laterally offset inward toward the first interior side;

a fabric panel having first and second edges, the first and second edges generally parallel to one another;

a first rod connected to the first edge and inserted into the first side rail J-channel;

a first locking strip inserted into the first side rail J-channel and configured to lock the first rod and first edge into the first side rail J-channel;

a second rod coupled to the second edge and inserted into the second side rail J-channel; and a second locking strip inserted into the second side rail J-channel and configured to lock the second rod and second edge into the second side rail J-channel;

wherein the foot has a foot area having a shape conforming to a shape of the rod so that the foot area is configured to receive the first rod from the neck of the J-channel;

wherein the shape of the foot area is partially defined by a ledge of a top of the side rail, the ledge having a top that is substantially flat and generally parallel to a base of the first side rail, the ledge having a variable thickness and further having a lip, the lip extending vertically below an uppermost point of an underside surface of the ledge.

16. The sling chair of claim 15, wherein each J-channel comprises a neck and a laterally offset foot, the laterally offset foot being laterally offset inward toward a respective side rail interior side, such that the first edge and the first rod are received in the first side rail J-channel foot, and the second edge and the second rod are received in the second side rail J-channel foot.

17. The sling chair of claim 16, wherein the first locking strip is force fit in the first side rail J-channel and comprises a lateral protrusion configured for mating with a corresponding ridge formed in the first side rail J-channel.

18. A sling chair comprising:

a frame having a first side rail and a second side rail, the first and second side rails each generally parallel to one another once assembled, each side rail having a J-channel along a length of the rail, wherein the first side rail J-channel has a neck and a laterally offset foot disposed at a lower portion of the neck;

a fabric panel having first and second edges, the first and second edges generally parallel to one another;

a first rod coupled to the first edge and inserted into the neck of the first side rail J-channel; and a first locking strip inserted into the first side rail J-channel and configured to lock the first rod and the first edge into the first side rail J-channel;

wherein a shape of the foot area conforms to a shape of the rod, the shape of the foot area partially defined by a ledge of a top of the side rail, the ledge having a top that is substantially flat and generally parallel to a base of the first side rail, the ledge further having a lip extending vertically below an uppermost point of an underside surface of the ledge;

wherein when the sling chair is engaged, the shape of the foot area, the ledge, and the locking strip are in contact with the fabric panel;

wherein the first and second ends of the fabric panel are secured in the first and second side rails such that if a downward force is applied to a central area of the fabric panel, the first and second ends of the fabric panel are each configured to offset the downward force and are arranged in a mirror image of one another.

19. The sling chair of 38, wherein the neck has side walls that are generally parallel to one another and the side walls are approximately the same length, and wherein the sling chair is configured such that a friction force is distributed between the ledge, the foot area, and the locking strip.

* * * * *